US010241475B2

(12) United States Patent
Favre et al.

(10) Patent No.: US 10,241,475 B2
(45) Date of Patent: Mar. 26, 2019

(54) TIMEPIECE REGULATING MECHANISM WITH OPTIMISED MAGNETIC ESCAPEMENT

(71) Applicant: The Swatch Group Research and Development Ltd, Marin (CH)

(72) Inventors: Jerome Favre, Neuchatel (CH); Gianni Di Domenico, Neuchatel (CH); Dominique Lechot, Les Reussilles (CH); Jean-Jacques Born, Morges (CH); Baptiste Hinaux, Lausanne (CH)

(73) Assignee: The Swatch Group Research and Development Ltd, Marin (CH)

( * ) Notice: Subject to any disclaimer, the term of this patent is extended or adjusted under 35 U.S.C. 154(b) by 37 days.

(21) Appl. No.: 15/399,224

(22) Filed: Jan. 5, 2017

(65) Prior Publication Data

US 2017/0261933 A1 Sep. 14, 2017

(30) Foreign Application Priority Data

Mar. 11, 2016 (EP) ..... 16159796

(51) Int. Cl.
*G04B 1/22* (2006.01)
*G04C 3/06* (2006.01)
(Continued)

(52) U.S. Cl.
CPC ..... *G04C 5/005* (2013.01); *G04B 1/22* (2013.01); *G04B 13/001* (2013.01); *G04B 15/14* (2013.01);
(Continued)

(58) Field of Classification Search
CPC ..... G04C 5/00; G04C 5/005
See application file for complete search history.

(56) References Cited

U.S. PATENT DOCUMENTS 20,888 A * 7/1858 Muna ..... G04B 15/02 368/206
2,091,841 A * 8/1937 Warren ..... G04C 5/005 310/103
(Continued)

FOREIGN PATENT DOCUMENTS

CH 706 209 A2 9/2013
CH 709 031 A2 6/2015
(Continued)

OTHER PUBLICATIONS

Gauthier, Romain, English Translation of CH706209, originally published Sep. 13, 2018, retrieved from Espacenet on Mar. 19, 2018, full document.*
(Continued)

*Primary Examiner* — Daniel P Wicklund
(74) *Attorney, Agent, or Firm* — Oblon, McClelland, Maier & Neustadt, L.L.P.

(57) ABSTRACT

Timepiece regulating mechanism including an energy storage means delivering an output torque (CS), via a train (3), to a wheel set (4) forming a magnetic escapement mechanism (10) with a resonator wheel set (5) subjected to the torque from a return means (6) and cooperating therewith, either directly or via a magnetic stop member (7), this magnetic escapement mechanism (10) being arranged to operate when the wheel set (4) receives a torque higher than or equal to a maintenance torque (CE), and the train (3) includes a torque regulating means (30) arranged to deliver to the wheel set (4) a constant torque comprised between 1.0 and 2.0 times the maintenance torque (CE), the torque regulating means (30) including a fusee (8) of continuously variable cross-section, from which unwinds a chain (9), wound by a drum (21), directly or indirectly driven by the energy storage means (2).

7 Claims, 3 Drawing Sheets

(51) Int. Cl.

| | |
|---|---|
| ***G04C 5/00*** | (2006.01) |
| ***G04B 13/00*** | (2006.01) |
| ***G04B 15/14*** | (2006.01) |
| ***G04B 17/26*** | (2006.01) |
| ***G04B 17/32*** | (2006.01) |

(52) U.S. Cl.

CPC ..... *G04B 17/26* (2013.01); *G04B 17/32* (2013.01); *G04C 3/06* (2013.01); *G04C 3/061* (2013.01); *G04C 3/062* (2013.01); *G04C 3/063* (2013.01); *G04C 3/064* (2013.01); *G04C 3/065* (2013.01)

(56) References Cited

U.S. PATENT DOCUMENTS

| | | | | | |
|---|---|---|---|---|---|
| 2,496,690 | A * | 2/1950 | Bennett, Jr. | G04C 13/06 | 368/185 |
| 2,914,956 | A | 12/1959 | Maclay | | |
| 3,183,426 | A * | 5/1965 | Haydon | G04C 5/005 | 368/132 |
| 3,485,032 | A * | 12/1969 | Ishikawa | G04C 5/005 | 368/126 |
| 3,609,958 | A * | 10/1971 | Bertsch | G04C 5/005 | 310/37 |
| 2008/0225646 | A1 | 9/2008 | Zaugg | | |
| 2010/0243377 | A1* | 9/2010 | Duval | F16F 1/121 | 185/37 |
| 2015/0131413 | A1* | 5/2015 | Helfer | G04C 3/042 | 368/77 |

FOREIGN PATENT DOCUMENTS

| | | | |
|---|---|---|---|
| EP | 1 914 604 | A1 | 4/2008 |
| EP | 1 970 778 | A1 | 9/2008 |
| EP | 2 911 015 | A2 | 8/2015 |
| JP | 52040366 | U * | 3/1977 |

OTHER PUBLICATIONS

European Search Report dated Sep. 1, 2016 in European application 16159796.8, filed on Mar. 11, 2016 (with English Translation of Categories of Cited Documents).

* cited by examiner

Fig. 4
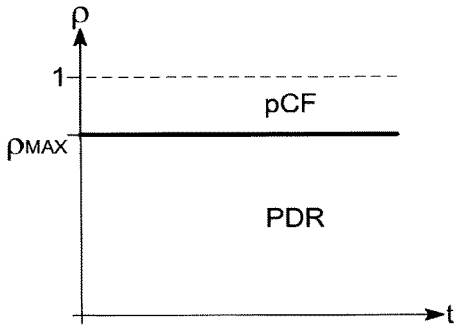
Fig. 5
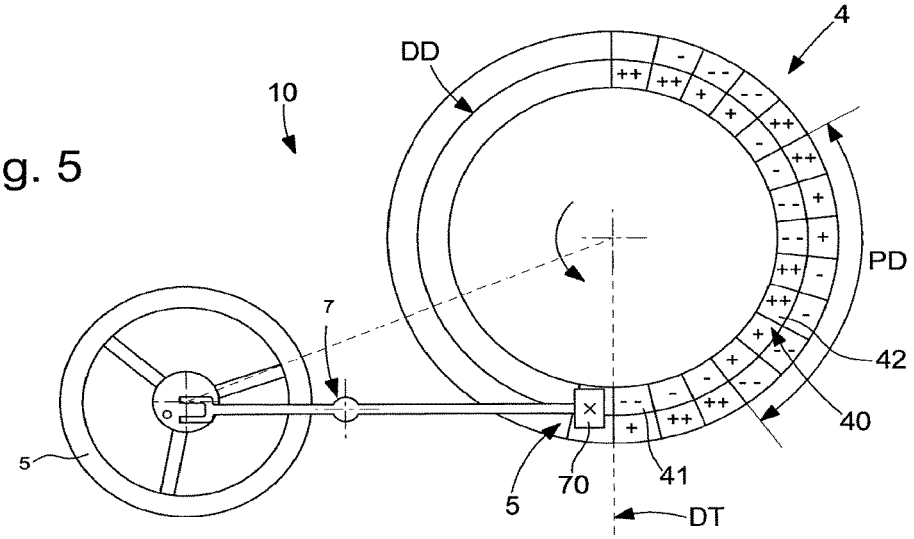
Fig. 6
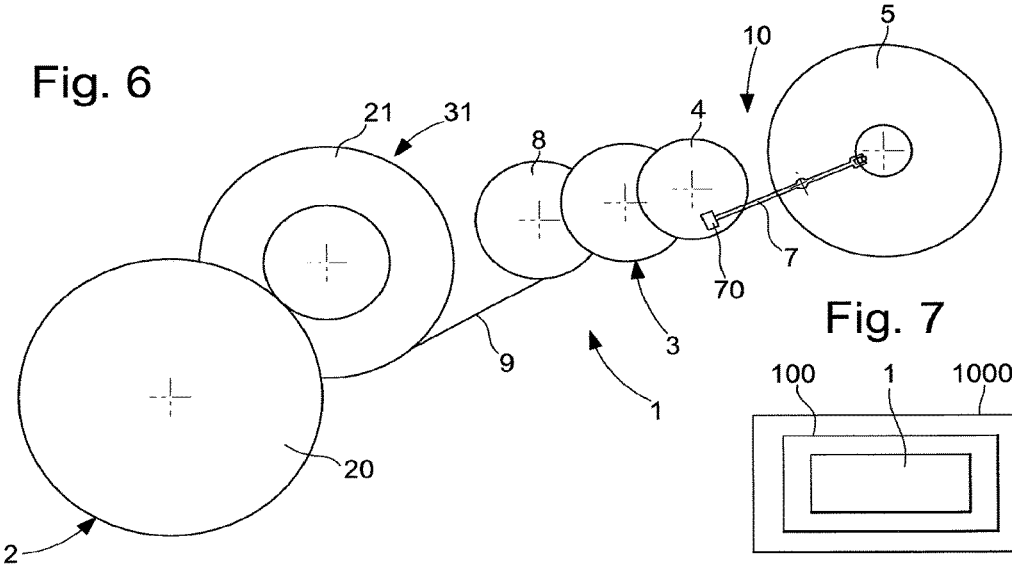
Fig. 7

TIMEPIECE REGULATING MECHANISM WITH OPTIMISED MAGNETIC ESCAPEMENT

This application claims priority from European Patent Application No. 16159796.8 filed on Mar. 11, 2016, the entire disclosure of which is hereby incorporated herein by reference.

FIELD OF THE INVENTION

The invention concerns a timepiece regulating mechanism with a magnetic escapement including an energy storage means arranged to deliver energy in the form of an output torque, by means of a transmission train, to a magnetic escape wheel set forming a magnetic escapement mechanism with a resonator wheel set subjected to the torque from a return means, said magnetic escape wheel set cooperating with said resonator wheel set, either directly or by means of a magnetic stop member, said magnetic escapement mechanism being arranged to operate when said magnetic escapement mechanism receives a torque higher than or equal to a maintenance torque specific to said magnetic escapement mechanism.

The invention also concerns a timepiece movement including such a regulating mechanism.

The invention also concerns a watch including such a timepiece movement.

The invention concerns the field of timepiece regulating mechanisms, and more particularly field-effect, contactless or reduced contact escapement mechanisms of the magnetic or electrostatic type.

BACKGROUND OF THE INVENTION

The efficiency of a conventional Swiss lever escapement mechanism is typically 35% or 40% at best. In such an escapement, the interaction between the escape wheel and the pallet lever, in the usual case of steel teeth on ruby pallet stones, generates considerable friction, and impairs the efficiency of the escapement.

EP Patent 13199427 in the name of SWATCH GROUP RESEARCH & DEVELOPMENT Ltd, incorporated herein by reference, proposed replacing this mechanical interaction with magnetic forces using repelling magnets, which greatly reduced losses through friction.

However, efficiency is intrinsically linked to the level of torque provided by the barrel, due to the design of the magnetic pallet lever escapement. Indeed, it is a constant force escapement, i.e. it theoretically always supplies the same energy to the resonator. A variable portion of surplus energy is dissipated in the rebounds of the magnetic escape wheel. The higher the input torque at the escape wheel, the higher will be the total power provided by the barrel, which causes the magnetic escape wheel to rebound longer. This phenomenon results in diminished efficiency of the escapement when the torque at the escape wheel is high.

With low torque, the portion due to wheel rebounds is low. The efficiency of the escapement is high, much greater than that of a conventional Swiss lever escapement.

With high torque, the portion due to wheel rebounds is high. The efficiency of the escapement is lower than with a low torque, and is at a level comparable to that of a conventional Swiss lever escapement.

EP Patent 2911015 in the name of SWATCH GROUP RESEARCH & DEVELOPMENT LTD discloses a timepiece escapement mechanism comprising a stop member between, on the one hand, a resonator, and on the other hand, two escape wheel sets each subjected to a torque. Each escape wheel set includes a track that is magnetized or ferromagnetic according to a period. The stop member comprises at least one magnetized or ferromagnetic pole piece, transversely movable with respect to the travel of one surface of the track. The pole piece or the track creates a magnetic field between the pole piece and the surface. The pole piece is confronted by a magnetic or electrostatic field barrier on the track just before each transverse motion of the stop member controlled by the periodic action of the resonator. The escape wheel sets are each arranged to cooperate alternately with the stop member and are connected to each other by a direct kinematic connection.

CH Patent 706209 in the name of MONTRES ROMAIN GAUTHIER SA discloses a watch movement including at least one barrel and one gear train for transmitting energy from the barrel to other elements of the movement. The gear train includes a reduction gear with a first transmission ratio of 1, a torque compensation system with a cam downstream of the reduction gear to compensate for the variation in torque supplied by the barrel according to the strain state of the barrel, and a gear system with a second transmission ratio greater than 1 for driving the other elements of the movement. The torque compensation system includes a chain arranged to be wound over less than one turn or to unwind about the cam depending on the strain state of the barrel.

EP Patent 1914604 in the name of GIRARD PERREGAUX SA discloses a movement including an energy source having an output torque that varies according to its state of charge, intended to maintain the oscillating motion of a mechanical oscillator by means of a going train including a compensation device, this latter having an input kinematically connected to the energy source and an output kinematically connected to the mechanical oscillator, and being arranged to transmit a substantially constant torque to the mechanical oscillator regardless of the state of charge of the energy source. This compensation device includes a cam have a periphery of variable radius extending substantially in one plane, the variations of the cam radius being a function of those of the output torque from the energy source, and further includes an intermediate connecting mechanism arranged to ensure a substantially slip-free kinematic connection between the cam periphery and the going train.

SUMMARY OF THE INVENTION

The invention proposes to optimise the use of energy from the energy source, particularly from a barrel, by making a magnetic escapement mechanism operate as close as possible to the value of the minimum maintenance torque for ensuring operation, and at which efficiency is greatest. It also proposes to keep this minimum torque constant for as long as possible, with the aid of a mechanism regulating the input torque at the escape wheel set, particularly by using a fusee-chain type transmission.

Since Leonardo da Vinci around 1540, the fusee has been known for regulating the drive force transmitted to the gear train and for overcoming the problem of loss of torque of a conventional barrel: it is thus usually used in the highest possible torque range, to offset the loss of power by the increase in torque.

From the normal use of a fusee-chain, the invention retains only its ability to deliver a substantially constant torque. The torque regulating mechanism is advantageously combined with a reduction transmission to lower the level of torque coming from the energy source, so that, at the start of letting down, the torque level provided to the escape wheel set is equal to or slightly greater than the maintenance torque value of the magnetic escapement. Of course, due to the torque regulation, at the end of the letting down of the energy source, the torque level supplied to the escape wheel set remains the same.

To this end, the invention concerns a timepiece regulating mechanism according to claim 1.

The invention also concerns a timepiece movement including such a regulating mechanism.

The invention also concerns a watch including such a movement.

BRIEF DESCRIPTION OF THE DRAWINGS

Other features and advantages of the invention will appear upon reading the following detailed description, with reference to the annexed drawings, in which:

FIG. 2 shows the absolute channels of loss in a conventional magnetic escapement, where only losses due to rebounds of the magnetic escape wheel vary when the torque varies, and FIG. 3 represents the relative channels of loss in a conventional magnetic escapement: the escapement efficiency is low when the torque is high, and high when the torque is low.

FIG. 4 is a graph illustrating the consistency of efficiency over time for a regulating mechanism according to the invention.

FIG. 5 represents a schematic plan view of a non-limiting example of a magnetic escapement mechanism incorporated in such a regulating mechanism according to the invention.

FIG. 6 shows a schematic, plan view of a non-limiting example of a gear train according to the invention.

FIG. 7 is a block diagram representing a watch including a movement equipped with such an optimised magnetic pallet lever escapement mechanism.

DETAILED DESCRIPTION OF PREFERRED EMBODIMENTS

The invention concerns the field of timepiece regulating mechanisms, and more particularly field-effect, contactless or reduced contact escapement mechanisms of the magnetic or electrostatic type.

Figure 2:
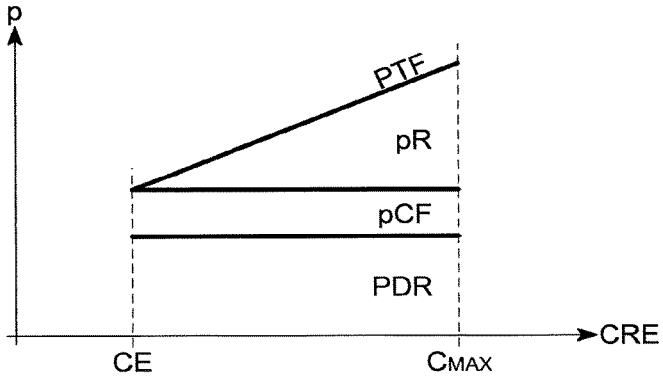
FIGS. 2 and 3 are graphs illustrating the decrease in efficiency of a magnetic escapement when the torque is high.
Figure 3:
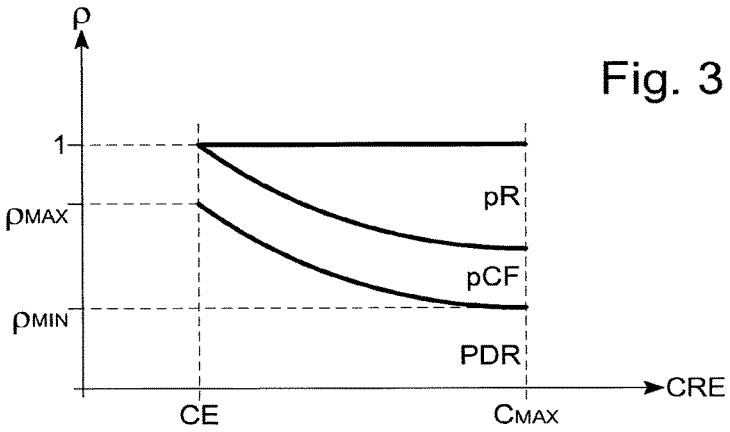
Figure 8:
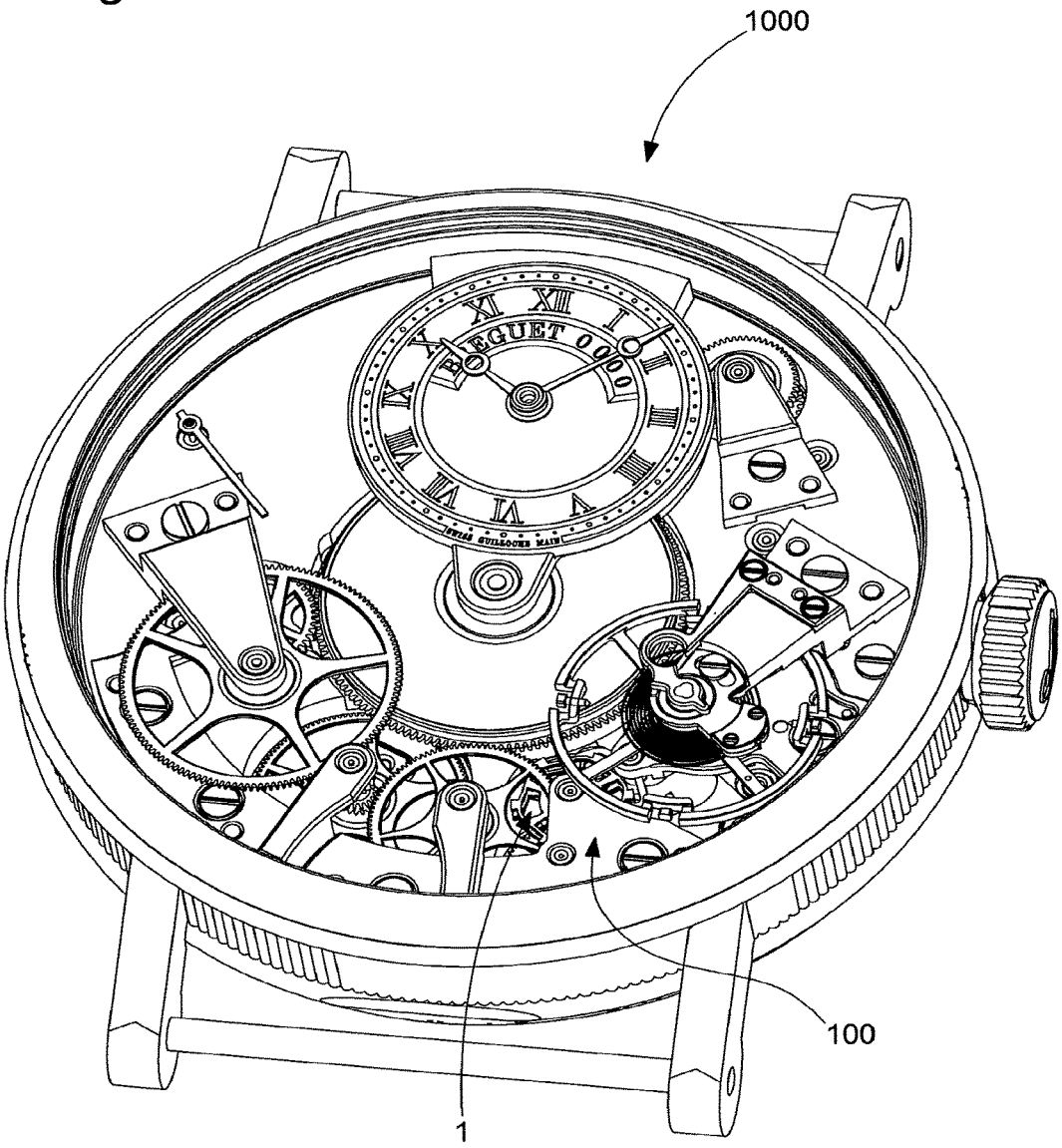
FIG. 8 shows a schematic perspective view of such a watch.

FIGS. 2 and 3 are graphs illustrating the decrease in efficiency of a magnetic escapement when there is an increase in the torque applied to the escape wheel set, generally an escape wheel.

FIG. 2 shows the losses on the ordinate and the torque applied to the escape wheel set on the abscissa. It illustrates the absolute channels of loss in a conventional escapement mechanism, where only the losses pR due to rebounds of the escape wheel set, particularly a magnetic escape wheel, vary when the torque varies. These rebounds consume unusable excess energy, dissipated in the air and in the pivots. The upper curve PTF illustrates the total power provided, which is the sum of the power dissipated by resonator PDR which is at a constant level, which is the advantage of a magnetic or electrostatic escapement, of losses through shocks and friction pCF (which are considerable when the escapement mechanism includes a stop member such as a pallet lever or similar) and of losses through rebound pR, which represent the surplus energy consumption, which is inefficient.

The level of torque applied to the escape wheel set, required for operation of the system, is the maintenance torque CE, at which losses through rebound are minimum or zero; the maximum level of torque CMAX depends on the energy source and on the gear train that transmits the energy to the escape wheel set.

FIG. 3 shows efficiency on the ordinate and the torque applied to the escape wheel set on the abscissa. It illustrates the relative channels of loss in the same conventional magnetic escapement: the escapement efficiency is low at level pMIN when the torque is high at value CMAX, and it is high at level pMAX when the torque is at value CE.

The invention thus proposes to control losses, and to avoid wasting energy, by limiting or completely eliminating rebounds. To this end, it proposes to subject the escape wheel set to a constant torque, with a value at least equal to maintenance torque CE. FIG. 4 thus shows the consistency of efficiency p over time at value p MAX.

The invention is described here in a particular, non-limiting embodiment, which is that of a magnetic escapement. It can be implemented in an electrostatic embodiment, with reference to the aforecited EP Patent 13199427.

It is also illustrated in a particular non-limiting variant of a magnetic escapement including a stop member, described in the same document.

The invention can equally be implemented in a variant without a stop member, with a direct interaction between an escape wheel set and a balance or similar, described in particular in EP Patent 14186261.5 in the name of Nivarox-FAR SA, incorporated herein by reference.

Figure 1:
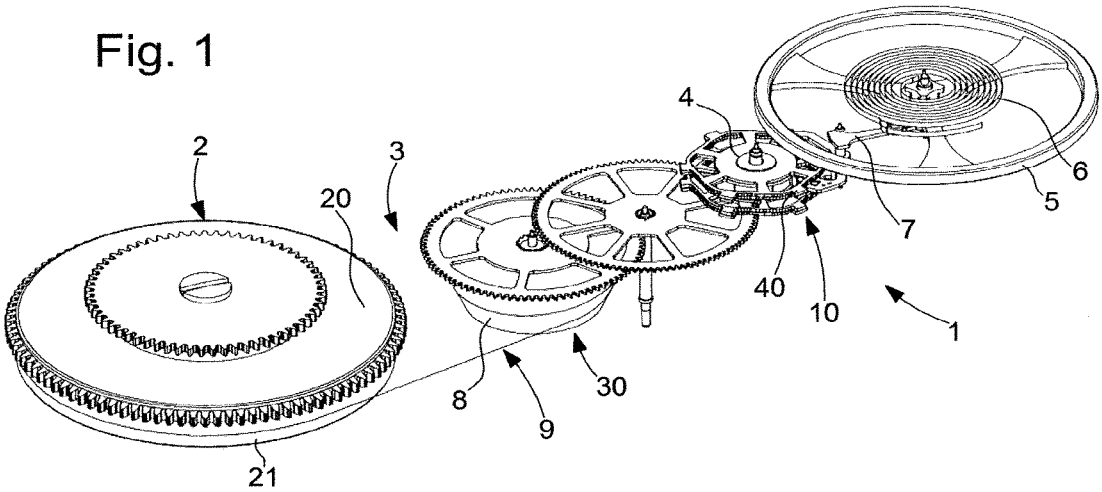
FIG. 1 represents a schematic perspective view of a timepiece regulating mechanism with a magnetic pallet lever escapement mechanism optimised according to the invention through the insertion of a fusee-chain transmission.

FIG. 1 shows a non-limiting construction example of a timepiece regulating mechanism 1 including a magnetic pallet lever escapement mechanism 10, optimised in accordance with the invention. The invention combines the advantages of a field-effect escapement, particularly of a magnetic pallet lever escapement in the variant illustrated by the Figures, which is a constant force mechanism as regards the resonator wheel set, typically a balance, with the advantages of a torque regulating mechanism. More particularly, the transmission of torque from an energy source 2, especially but not limited to at least one barrel 20, by a constant torque system, for example a fusee-chain, ensure an almost constant torque at the escapement.

The torque value CE provided to the escape wheel set must be chosen to be low, so that the escapement has the highest efficiency, on the order of 60% to 70%.

Thus, the invention concerns a timepiece regulating mechanism 1 with a magnetic escapement including an energy storage means 2 arranged to deliver energy in the form of an output torque CS, by means of a transmission train 3, to a magnetic escape wheel set 4.

This magnetic escape wheel set 4, illustrated here in the form of a magnetic escape wheel, forms a magnetic escapement mechanism 10 with a resonator wheel set 5 subjected to the torque from a return means 6, respectively illustrated here in the form of a balance and a balance spring.

Magnetic escape wheel set 4 cooperates with resonator wheel set 5, either directly, or via a magnetic stop member 7, illustrated here in the form of a magnetic pallet lever.

Magnetic escapement mechanism 10 is arranged to operate when magnetic escape wheel set 4 receives a torque higher than or equal to a maintenance torque CE specific to magnetic escapement mechanism 10.

According to the invention, transmission train 3 includes a torque regulating means 30, which is arranged to deliver to magnetic escape wheel set 4 a constant torque comprised between 1.0 and 2.0 times the maintenance torque CE, more particularly between 1.0 and 1.5 times the maintenance torque CE, more particularly still between 1.0 and 1.2 times the maintenance torque CE, and as close as possible to maintenance torque CE, depending upon the torque consuming complications, and the structure of the going train. This torque corresponds to auto-start and to the elimination of rebounds.

Naturally, the invention also concerns the variant with an electrostatic escapement, which is not described in detail, and which those skilled in the art will know how to implement with reference to the aforecited documents.

In an advantageous application and as seen in FIG. 1, torque regulating means 30 includes a fusee 8 of continuously variable cross-section, from which unwinds a chain 9, wound by a drum 21, directly or indirectly driven by energy storage means 2.

More particularly, energy storage means 2 includes at least one barrel 20. The invention thus uses, in an optimum manner, all the energy from the barrel, which no longer rotates at constant velocity, since its instantaneous tangential velocity depends on the instantaneous winding radius of chain 9 on fusee 8.

In a variant, seen in FIG. 6, transmission train 3 includes a speed increasing gear train 31, arranged to transform output torque CS into a lower intermediate torque CI, at the input of torque regulating means 30.

In a variant, seen in FIG. 5, magnetic escapement mechanism 10 includes a magnetic stop member 7 between magnetic escape wheel set 4 and resonator wheel set 5. This escape wheel set 4 includes at least one magnetized or ferromagnetic track 40, with a period of travel PD in which the magnetic characteristics are repeated. Stop member 7 includes at least one magnetized or ferromagnetic pole piece 70, and this pole piece 70 is mobile in a transverse direction DT relative to the direction of travel DD of at least one component of a surface 41 of track 40. At least pole piece 70 or track 40 creates a magnetic field in an airgap 5 between the at least one pole piece 70 and the at least one surface 41. Pole piece 70 is confronted with a magnetic field barrier 42 on track 40 just before each transverse motion of stop member 7 controlled by the periodic action of resonator wheel set 5.

The invention also concerns a timepiece movement 100 including such a regulating mechanism 1.

The invention also concerns a watch 1000 including a movement 100 of this type.

In short, the high efficiency value, which has become constant, makes it possible to increase the power reserve by more than 50% compared to a conventional (mechanical or magnetic) Swiss lever configuration, for a given barrel, resonator and regulating power.

For the user, this means that the watch can go longer without needing to be wound or recharged (spring).

The invention combines the regularity of rate specific to the field effect escapement mechanism, particularly a magnetic escapement, with a considerable energy saving.

What is claimed is:

1. A timepiece regulating mechanism with a magnetic escapement, including a transmission train, a magnetic escape wheel set, a resonator wheel set, and a return mechanism, said regulating mechanism including an energy storage mechanism delivering energy as an output torque via said transmission train, to said magnetic escape wheel set, forming a magnetic escapement mechanism with said resonator wheel set subjected to a return torque from said return mechanism, said magnetic escape wheel set cooperating with said resonator wheel set, either directly, or via a magnetic stop member of said regulating mechanism, said magnetic escapement mechanism being arranged to operate when said magnetic escape wheel set receives a torque higher than or equal to a maintenance torque specific to said magnetic escapement mechanism, wherein said transmission train includes a torque regulator arranged to deliver to said magnetic escape wheel set a constant torque comprised between 1.0 and 2.0 times said maintenance torque, said torque regulator including a fusee of continuously variable cross-section from which unwinds a chain wound by a drum driven by said energy storage mechanism, said magnetic escape wheel set including at least one magnetized or ferromagnetic track with an interior track portion and exterior track portion providing a period of travel between the interior track portion and the exterior track portion said stop member including at least one magnetized or ferromagnetic pole piece, and said pole piece being mobile in a transverse direction relative to the direction of travel of at least one element on a top surface of said track.

2. The regulating mechanism according to claim 1, wherein said energy storage mechanism includes at least one barrel.

3. The regulating mechanism according to claim 1, wherein said transmission train includes a speed increasing gear train, arranged to transform said output torque into a lower intermediate torque, at an input of said torque regulator.

4. The regulating mechanism according to claim 1, wherein said magnetic escapement mechanism includes said magnetic stop member between said magnetic escape wheel set and said resonator wheel set, said at least one magnetized or ferromagnetic track with another period of travel in which magnetic characteristics along a portion of said track are repeated, and at least said pole piece or said track creating a magnetic field in an air-gap between said at least one pole piece and said surface, and further wherein said pole piece is confronted by a magnetic field barrier on said track just before each transverse motion of said stop member controlled by the periodic action of said resonator wheel set.

5. A timepiece movement including the regulating mechanism according to claim 1.

6. A watch including a timepiece movement according to claim 5.

7. The regulating mechanism according to claim 1, wherein the drum and barrel are coaxial.

* * * * *